US012372340B2

(12) United States Patent
Segelman et al.

(10) Patent No.: US 12,372,340 B2
(45) Date of Patent: Jul. 29, 2025

(54) VERTICAL INTERLOCKING STORAGE SYSTEM

(71) Applicant: Hardcore Storage Solutions, Macon, GA (US)

(72) Inventors: Leo Blake Segelman, Smyrna, GA (US); Kerry Warren Hatcher, Macon, GA (US)

(73) Assignee: Hardcore Storage Solutions LLC, Macon, GA (US)

( * ) Notice: Subject to any disclaimer, the term of this patent is extended or adjusted under 35 U.S.C. 154(b) by 85 days.

(21) Appl. No.: 18/317,592

(22) Filed: May 15, 2023

(65) Prior Publication Data

US 2024/0384974 A1 Nov. 21, 2024

(51) Int. Cl.

| | |
|---|---|
| ***F42B 39/22*** | (2006.01) |
| ***B65D 25/08*** | (2006.01) |
| ***B65D 25/10*** | (2006.01) |
| ***F42B 39/26*** | (2006.01) |

(52) U.S. Cl.

CPC ..... *F42B 39/22* (2013.01); *B65D 25/08* (2013.01); *B65D 25/108* (2013.01); *F42B 39/26* (2013.01)

(58) Field of Classification Search

CPC ..... B65D 25/08; B65D 25/108; F42B 39/22; F42B 39/26

USPC ..... 206/3, 433; 220/512, 509, 510; 86/44

See application file for complete search history.

(56) References Cited

U.S. PATENT DOCUMENTS

| | | | | |
|---|---|---|---|---|
| 2,795,323 | A * | 6/1957 | Amundsen | F42B 39/26 86/44 |
| 3,184,071 | A * | 5/1965 | Delaire | B65D 11/22 211/74 |
| 3,643,812 | A * | 2/1972 | Mander | B01L 9/06 220/519 |
| 4,284,603 | A * | 8/1981 | Korom | B01L 9/06 210/473 |
| 4,538,723 | A * | 9/1985 | Johnson | F42B 39/26 206/443 |
| 4,901,846 | A * | 2/1990 | Lehman | B44D 3/04 206/821 |
| 5,009,314 | A * | 4/1991 | Arthurs | B65D 1/243 206/427 |

(Continued)

OTHER PUBLICATIONS

Ammo Can 3d printed ammo storage, Title: Ammo can 3d printed ammo storage, retrieved on: Apr. 28, 2023, p. 1.

(Continued)

*Primary Examiner* — Anthony D Stashick
*Assistant Examiner* — Prince Pal
(74) *Attorney, Agent, or Firm* — Jeremy Briggs

(57) ABSTRACT

A storage system is disclosed. The system may include a bottom receptacle configured to hold a first set of items and a top receptacle configured to hold a second set of items. The top receptacle is configured to be stacked over the bottom receptacle. The system may further include a connector having a tubular body. The tubular body may have a connector distal portion and a connector proximal portion. The connector may include a locking mechanism disposed at the connector distal portion. The locking mechanism may be configured to lock the connector distal portion to a bottom receptacle proximal portion, and the connector proximal portion may be configured to removably attach to a top receptacle distal portion.

20 Claims, 5 Drawing Sheets

(56) References Cited

U.S. PATENT DOCUMENTS 5,271,520 A * 12/1993 McAfee ..... B01L 9/06 206/315.11
5,501,352 A * 3/1996 Apps ..... B65D 21/083 206/506
5,624,032 A * 4/1997 Yucknut ..... B65D 5/5059 229/120.32
5,975,300 A * 11/1999 Gale ..... B65D 5/503 206/592
6,132,684 A * 10/2000 Marino ..... B01L 9/06 422/561
6,290,057 B1 * 9/2001 Hurley ..... B65D 81/133 206/592
7,676,983 B2 * 3/2010 Jenkins ..... A01K 97/08 248/512
8,118,157 B1 * 2/2012 Piccolin ..... F42B 4/20 206/564
8,434,620 B2 * 5/2013 Hall ..... B65B 5/08 220/532
D685,971 S * 7/2013 Thibault ..... D32/54
9,038,817 B2 * 5/2015 Connolly ..... B65B 5/08 206/593
9,701,442 B1 * 7/2017 Heinrichs ..... B65D 19/385
9,956,684 B2 * 5/2018 Welfel ..... B25H 3/06
10,507,950 B2 * 12/2019 Carrier ..... B65D 5/5045
10,697,746 B2 * 6/2020 Lutz ..... F42B 39/26
10,721,874 B2 * 7/2020 Uglialoro ..... B42D 15/02
11,261,015 B2 * 3/2022 Gilligan ..... B65D 85/305
11,518,605 B1 * 12/2022 Schnell ..... B65D 81/133
D1,002,869 S * 10/2023 Rapier ..... D24/230
11,976,910 B1 * 5/2024 Small ..... F42B 39/26
12,031,805 B1 * 7/2024 Elfers ..... F42B 39/26
2008/0302691 A1 * 12/2008 Olson ..... B65D 5/48026 206/427
2011/0296800 A1 * 12/2011 Clark ..... B65D 5/503 53/443
2012/0037529 A1 * 2/2012 Hall ..... B65B 5/08 206/433
2015/0096907 A1 * 4/2015 Connolly ..... B65B 5/08 206/3
2015/0210457 A1 * 7/2015 DiMauro ..... B65B 61/207 53/472
2017/0073091 A1 * 3/2017 Deutschle ..... B65D 45/20
2019/0283933 A1 * 9/2019 Quan ..... A61M 37/00
2021/0107722 A1 * 4/2021 Whalen ..... B65D 43/163
2022/0371781 A1 * 11/2022 Hutterer ..... B65D 71/70
2022/0411132 A1 * 12/2022 Catalano ..... B65D 25/10
2023/0011990 A1 * 1/2023 Makos ..... A45C 13/02
2024/0083633 A1 * 3/2024 Inoue ..... B65D 5/5038
2024/0092531 A1 * 3/2024 Grabher ..... B65D 1/38

OTHER PUBLICATIONS

14" Shotshell Dry Box, Title: 14" Shotshell Dry Box, retrieved on: Apr. 28, 2023, p. 1.

* cited by examiner

VERTICAL INTERLOCKING STORAGE SYSTEM

TECHNICAL FIELD

The present disclosure relates to a vertical interlocking storage system, and more specifically to a vertical interlocking storage system that facilitates storage of a plurality of items in a container.

BACKGROUND

Users typically use ammunition containers to store and transport ammunition. Such ammunition containers protect the ammunition from moisture and keep the ammunition safe. The ammunition is usually packaged in cardboard boxes (of varying sizes), and the cardboard boxes are placed inside the ammunition containers to keep the ammunition dry and cool.

There are known instances of cardboard boxes being displaced or moved from their origin storage location in the ammunition containers, when the containers may be shipped or transported. Such box movement may cause the boxes to collide with each other or collide with ammunition container walls, thereby damaging the ammunition.

Thus, there is a need for a storage system that may facilitate a user in stably securing ammunition in the ammunition container.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
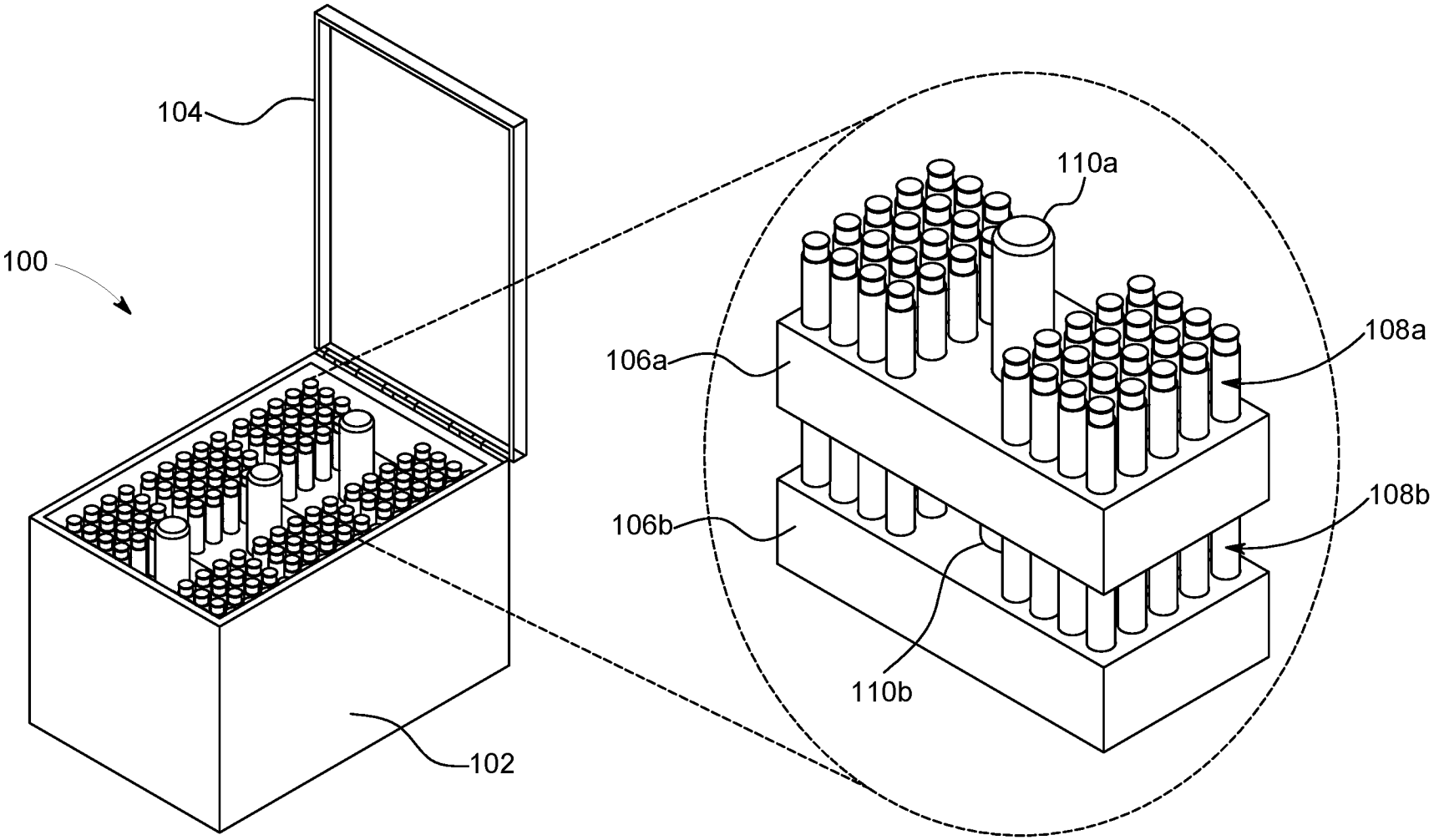
FIG. 1 depicts an example storage system in accordance with the present disclosure.

The present disclosure is directed towards a storage system for securely storing items (such as ammunition) in a container, for example, an ammunition container. The storage system may include a plurality of receptacles that may be stacked one over another inside the container. The plurality of receptacles may have equivalent dimensions. In some aspects, receptacle dimensions may correspond to container dimensions such that the receptacles may be closely packed in the container, thereby preventing receptacle movement during transport.

Each receptacle may include a plurality of slots that may be configured to receive and hold the items. Each slot may have equivalent dimensions, or one or more slots from the plurality of slots may have different dimensions. In some aspects, each receptacle may include same count and size of slots. In other aspects, the count and/or size of slots in one receptacle may be different from count and/or size of slots in another receptacle. In this manner, different receptacles associated with the storage system may hold same or different types and count of ammunition.

Each receptacle may include a stepped hole disposed at a receptacle center position. The stepped hole may be configured to receive and lock a connector (e.g., a first connector). The connector may be an elongated tubular body that may include a locking mechanism configured to lock a connector first end to a receptacle top portion (e.g., a first receptacle top portion), via the stepped hole. Another receptacle (e.g., a second receptacle) may be configured to be disposed or stacked over the first receptacle via the connector. For example, a connector second end may be inserted into a second receptacle bottom portion, via another stepped hole associated with the second receptacle. In this manner, the connector may be disposed between the first receptacle and the second receptacle, and may assist a user in placing the second receptacle over the first receptacle in a stacked arrangement. The second receptacle may include another connector (e.g., a second connector) that may be configured to be inserted and locked into a second receptacle top portion. Thus, the second receptacle may be attached to two connectors (the first connector and the second connector), and the two connectors may not contact each other. The second connector may assist the user in picking the second receptacle from "stacked" first and second receptacle arrangement, when the user desires to pick the second receptacle off the stacked arrangement.

The present disclosure discloses a storage system that may assist a user in safely storing items such as ammunition in an ammunition container. The storage system enables the user to conveniently store different types and sizes of ammunition in the ammunition container, and prevent ammunition movement during transport. Further, the storage system provides convenience to the user in loading/unloading ammunition to/from the storage system. In addition, the storage system enables the user to distribute ammunition to respective users. For example, the user may distribute the ammunition by conveniently "picking" respective receptacles from the stacked arrangement and distributing the receptacles to respective users.

These and other advantages of the present disclosure are provided in detail herein.

Illustrative Embodiments

The disclosure will be described more fully hereinafter with reference to the accompanying drawings, in which example embodiments of the disclosure are shown, and not intended to be limiting.

FIG. 1 depicts an example storage system 100 in accordance with the present disclosure. The storage system 100 may be an ammunition container (hereinafter referred to as container 100) that may be configured to store ammunition. The container 100 may be a waterproof, durable and rust-free container. The container 100 may be of any size and shape. For example, the container 100 may be shaped as a hollow cuboid that may be configured to store the ammunition in a container interior portion. Container walls may be made of any material including, but not limited to, wood, metal, plastic, and/or the like. Further, the container walls may have different dimensions based on a count of ammunition that the container 100 may store. For example, a container configured to store a large count of ammunition may have large container wall dimensions, and a container configured to store a relatively smaller count of ammunition may have smaller container wall dimensions.

Specifically, the container 100 may include a chamber 102 and a lid 104. The chamber 102 may be hollow from inside or may be a hollow chamber, and the lid 104 may be hinged at a chamber top surface. For example, as shown in FIG. 1, the lid 104 may be hinged at a top surface of a chamber side wall. The lid 104 may pivotally open via the top surface of a chamber side wall to provide access to a chamber interior portion (or the container interior portion), and pivotally close to cover the chamber interior portion.

In some aspects, a lid interior surface that faces the chamber interior portion and interior chamber walls may include rubber gaskets (not shown) that may protect the ammunition stored in the chamber interior portion from moisture. The lid 104 may further include a handle (not shown) on a lid exterior surface that may enable a user to conveniently carry the container 100 when the lid 104 may be closed, when the container 100 may be transported.

The container 100 may be configured to house a plurality of receptacles, for example, a top receptacle 106*a* and a bottom receptacle 106*b*. The container 100 may house a plurality of top receptacles and a plurality of bottom receptacles, disposed adjacent to each other. The top receptacle 106*a* may be stacked over the bottom receptacle 106*b*. The top receptacle 106*a* and the bottom receptacle 106*b* may have equivalent dimensions and may be made of same material. For example, the top receptacle 106*a* and the bottom receptacle 106*b* may be made of plastic, metal, etc. Structural details of the top receptacle 106*a* and the bottom receptacle 106*b* are described in conjunction with FIGS. 2-4.

Each receptacle may be configured to store a plurality of items, e.g., the ammunition described above. For example, the top receptacle 106*a* may hold/store a first set of items 108*a* and the bottom receptacle 106*b* may hold/store a second set of items 108*b*. In an exemplary aspect, the top receptacle 106*a* and the bottom receptacle 106*b* may include slots to hold respective items. For example, the top receptacle 106*a* may include a first set of slots (not shown in FIG. 1) and the bottom receptacle 106*b* may include a second set of slots (not shown in FIG. 1) that are configured to hold the first set of items 108*a* and the second set of items 108*b*, respectively.

The first set of items 108*a* may be same as or different from the second set of items 108*b*, and thus the first set of slots and the second set of slots may have equivalent or different sizes. For example, the top receptacle 106*a* may store ammunition of a first size (e.g., 9 mm), and the bottom receptacle 106*b* may store ammunition of a second size (e.g., 12 mm). Stated another way, the container 100 may be configured to store ammunition of different sizes. In addition, a count of first set of slots may be same or different from a count of second set of slots.

In some aspects, the receptacles (including the top receptacle 106*a* and the bottom receptacle 106*b*) may be stacked and stably held over each other using one or more connectors, for example, a first connector 110*a* and a second connector 110*b*. Each of the first connector 110*a* and the second connector 110*b* may have a tubular body and a locking mechanism (not shown in FIG. 1). The locking mechanism may enable the connector to be locked in respective receptacle. The details of the first connector 110*a* and/or the second connector 110*b*, and attachment of the first connector 110*a* and the second connector 110*b* with the top receptacle 106*a* and the bottom receptacle 106*b* may be understood in conjunction with FIGS. 3-4.

In some aspects, the top receptacle 106*a* and the bottom receptacle 106*b* (and other receptacles included in the container 100, not shown) may be manufactured and arranged in the container 100 such that there may be no or minimal movement of ammunition in the container 100 when the container 100 may be transported. For example, in some aspects, the container 100 may include one or more spacers (not shown) that may prevent receptacle movement (and thus ammunition movement) during transport. In an exemplary aspect, the spacer may be disposed between adjacent receptacles that may prevent receptacle movement or movement of ammunition that may be placed in the receptacles. In further aspects, the spacer may include a bin that may be configured to store additional items. In this case, the spacer may include a holding mechanism to hold the additional items inside the container 100.

In additional aspects, each of the top receptacle 106*a* and the bottom receptacle 106*b* may include a label (not shown) that may be configured to indicate details of ammunition that may be stored in respective receptacle. For example, the label may indicate ammunition size (e.g., 9 mm, 12 mm, etc.), receptacle allocation details, etc. In an exemplary aspect, the label may be disposed at a periphery of the top receptacle 106*a* and/or the bottom receptacle 106*b*, so that the user may easily view the label.

Although FIG. 1 describes an aspect where the container 100 (and the top and bottom receptacles 106*a*, 106*b*) may be configured to store ammunition, the present disclosure is not limited to ammunition storage. The present disclosure (e.g., the container 100) may be configured to store other items as well, e.g., batteries, tools, medical supplies, and/or the like, with departing from the present disclosure scope.

Figure 2:
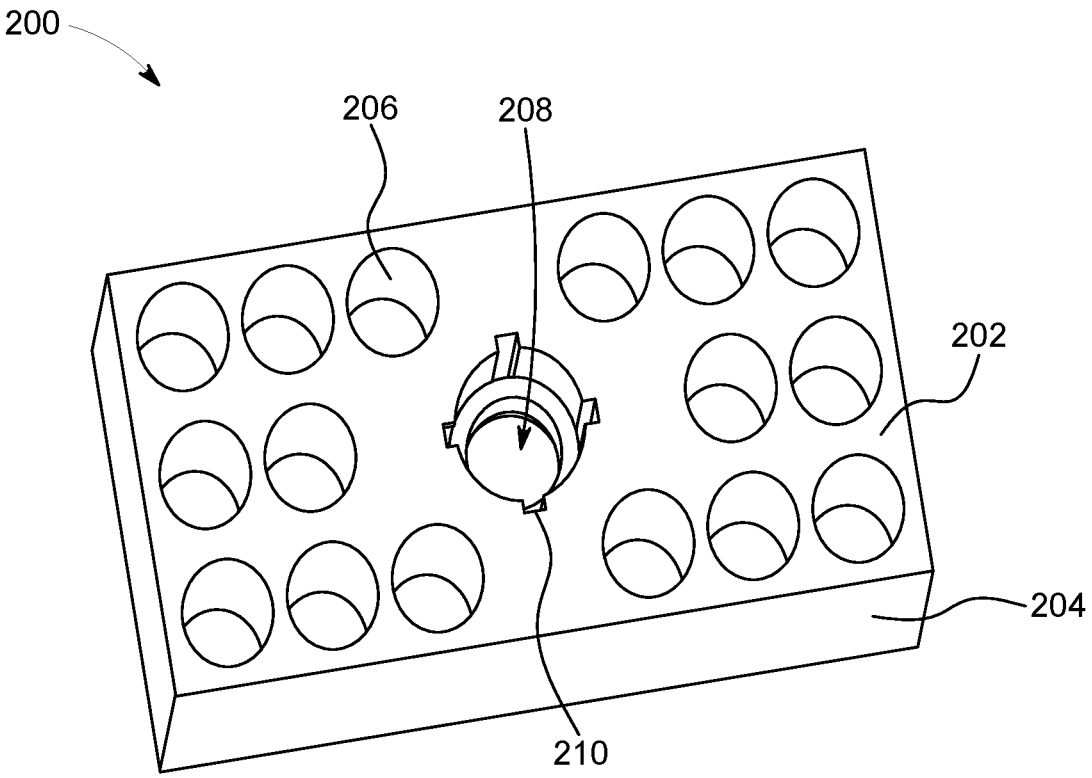
FIG. 2 depicts a top isometric view of an example receptacle in accordance with the present disclosure.
Figure 3:
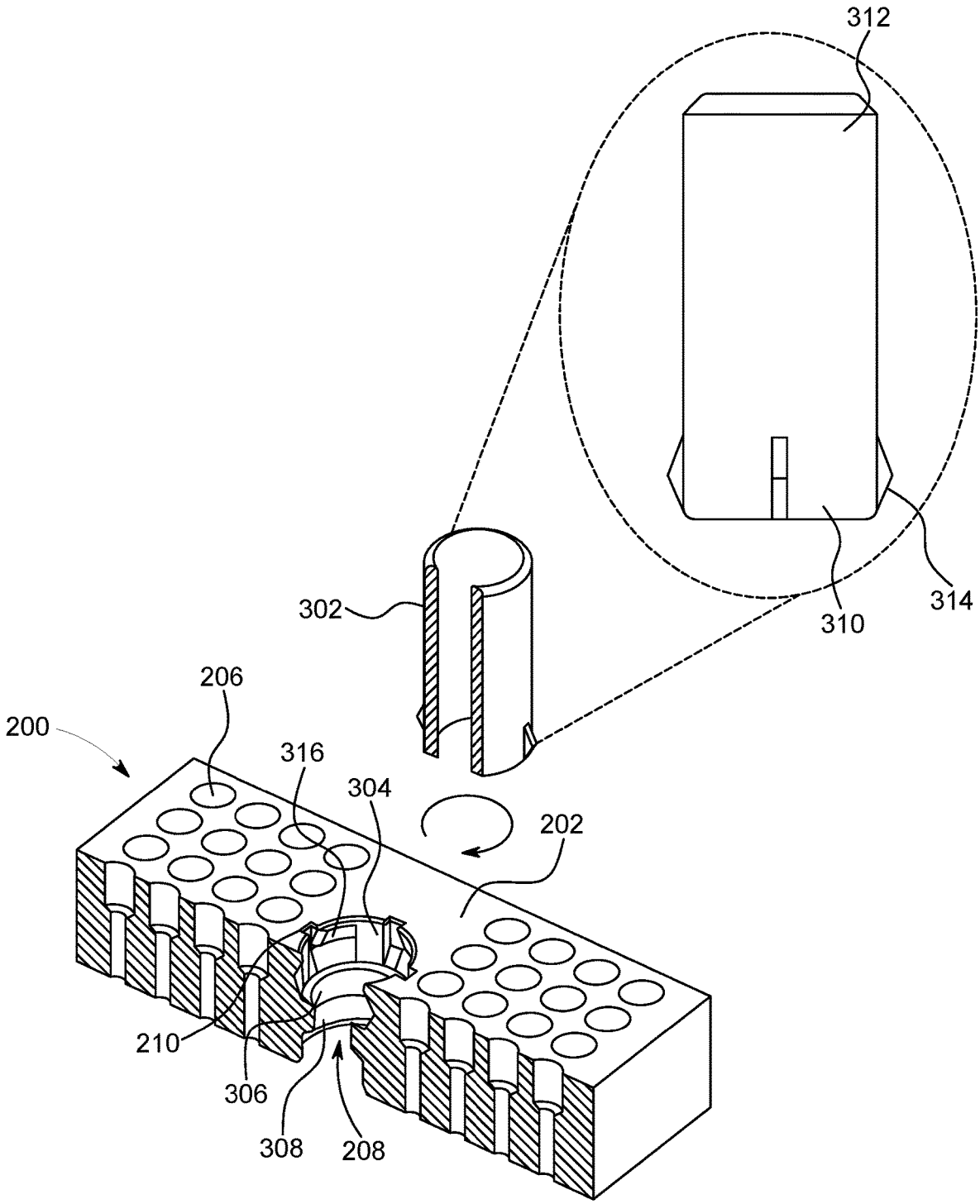
FIG. 3 depicts a sectional view of a receptacle and a connector in accordance with the present disclosure.
Figure 4:
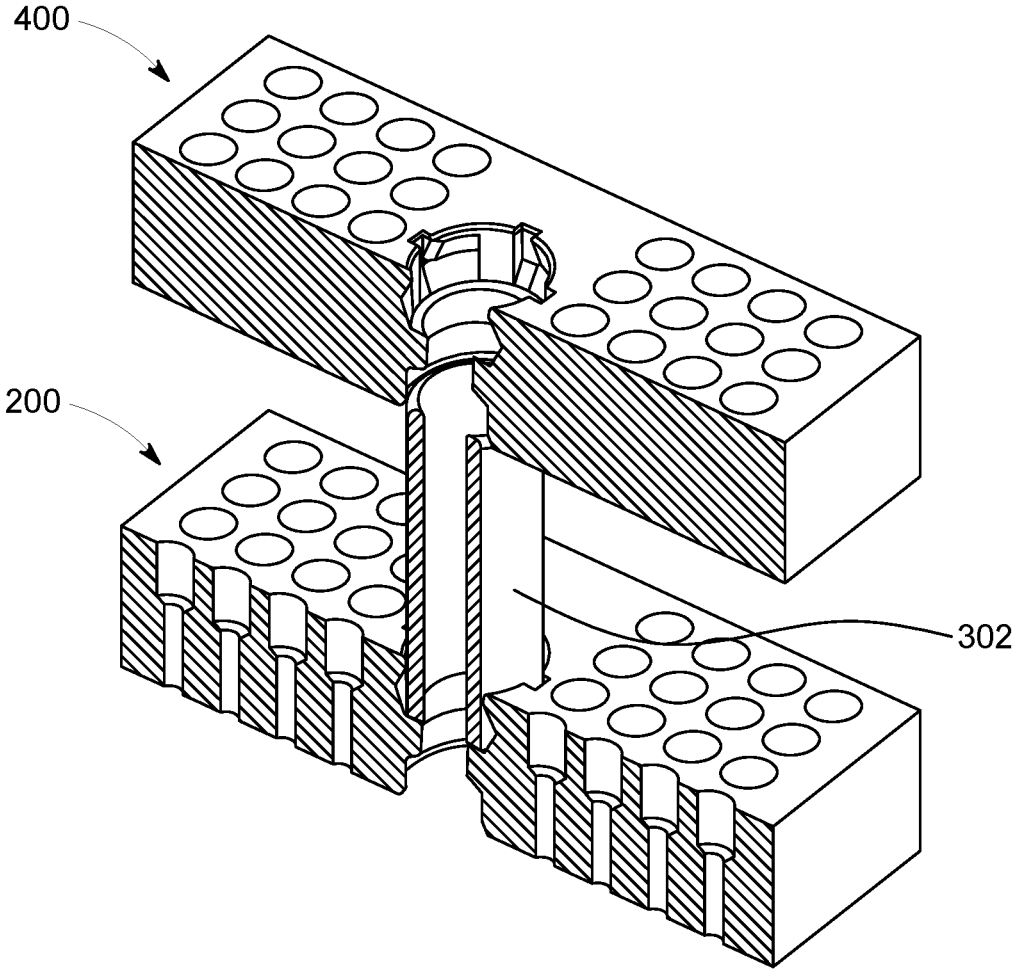
FIG. 4 depicts stacking of a plurality of receptacles in accordance with the present disclosure.

FIG. 2 depicts a top isometric view of an example receptacle 200 in accordance with the present disclosure. The receptacle 200 may be same as the bottom receptacle 102*b* (or the top receptacle 102*a*) described above in conjunction with FIG. 1. While describing FIG. 2, references will be made to FIGS. 3-4. FIG. 3 depicts a sectional view of the receptacle 200 and a connector 302, and FIG. 4 depicts stacking of a plurality of receptacles (such as receptacles 200 and 400) in accordance with the present disclosure.

The receptacle 200 may be of any shape, e.g., cuboidal, cylindrical, etc. In the exemplary aspect depicted in FIG. 2, the receptacle 200 is shown as being cuboidal in shape. The receptacle 200 may include a top surface 202, side surfaces (including a side surface 204), and a bottom surface (not shown). Dimensions of respective receptacle surfaces may vary based on size and type of ammunition that the receptacle 200 may be configured to hold.

The receptacle 200 may include a solid body including a plurality of slots 206 that may receive and hold a plurality of items (e.g., the first set of items 108*a* and the second set of items 108*b*). In an exemplary aspect, the plurality of items may be ammunition. The plurality of slots 206 may be distributed throughout a receptacle area, and each slot may be disposed at a predetermined distance from adjacent slots. Further, the plurality of slots 206 may be arranged in any pattern in the receptacle 200. Two exemplary slot patterns are depicted in FIGS. 2 and 3.

A slot count in the receptacle 200 may be based on ammunition size to be stored in the receptacle 200. In some aspects, all the slots may be of same size (e.g., having same diameter and depth). In other aspects, one or more slots from the slots 206 may be of different sizes. Size of each slot may depend on the ammunition size and type to be held in respective slot.

In an exemplary aspect, each slot 206 may be a counterbore (as depicted in FIG. 3) that may be configured to receive an ammunition. The user may insert the ammunition into the counterbore by inserting an ammunition top portion/tapered end into a counterbore top portion (or slot top portion). The slot 206 may stably hold the ammunition when the ammunition may be fully inserted into the counterbore and the ammunition top portion may be positioned in proximity to a counterbore bottom portion/end (or slot bottom portion/end). In an exemplary aspect, 30-60% of ammunition length may be inside the slot 206 and remaining length may be outside the slot 206, when the ammunition may be fully inserted into the counterbore/slot 206.

The receptacle 200 may further include a stepped hole 208 that may be disposed in a receptacle middle or center portion. The steeped hole 208 may be configured to receive the connector 302 (shown in FIG. 3, same as the connector 110*a*, 110*b*). The stepped hole 208 may have varying diameters along a hole depth. The stepped hole 208 may include a top portion 304, a middle portion 306, and a bottom portion 308. In some aspects, a top portion 304 diameter may be larger than a middle portion 306 diameter. Similarly, a bottom portion 308 diameter may be larger than the middle portion 306 diameter. In some aspects, the top portion 304 diameter may be equivalent to the bottom portion 308 diameter. In other aspects, the top portion 304 diameter may be different from the bottom portion 308 diameter. Since, the middle portion 306 diameter may be less than the top portion 304 diameter and the bottom portion 308 diameter, the middle portion 306 may act as a "positive stop" for the connector 302.

Respective diameters and depths of the top portion 304, the middle portion 306 and the bottom portion 308 may depend on receptacle 200 size and dimensions, and/or connector 302 size and dimensions. In some aspects, the diameters and depths of the top portion 304, the middle portion 306 and the bottom portion 308 may also depend on size and type of ammunition to be stored in the receptacle 200.

In some aspects, the top portion 304 may include one or more recesses 210 that may be disposed throughout a top portion depth. In an exemplary aspect, the top portion 304 may include four recesses 210 (as shown in FIG. 2), and each recess may be disposed at an equal distance (e.g., a predetermined distance) from adjacent recesses. The recesses 210 may enable the top portion 304 to receive the connector 302. The details of the connector 302 may be understood as follows.

The connector 302 may include a tubular elongated body made of plastic (or any other material). The connector 302 may be cylindrical in shape, as shown in FIG. 3. Connector dimensions (e.g., length and diameter) may depend on receptacle dimensions and/or stepped hole dimensions. The connector 302 may be a hollow body that may be configured to be inserted and locked into the stepped hole 208.

The connector 302 may include a connector distal portion 310 and a connector proximal portion 312. The connector 302 may further a locking mechanism disposed at the connector distal portion 310. The locking mechanism may include a plurality of locking pins 314 that may be configured to lock the connector 302 in the stepped hole 208. In some aspects, the locking pins 314 may be disposed on a connector distal portion exterior surface. Each locking pin 314 may be disposed at an equal distance (e.g., the predetermined distance) from adjacent locking pins. In some aspects, locking pin location on the connector distal portion exterior surface may be complementary to the recess location in the top portion 304. The locking pins 314 and connector tubular body may for a unified structure of the connector 302.

The plurality of locking pins 314 may be configured to lock the connector distal portion 310 in the top portion 304 (or a receptacle proximal portion). Specifically, the locking pins 314 may be inserted into the top portion 304 via the plurality of recesses 210. When the locking pins 314 may be inserted in the top portion 304, the user may rotate the connector 302 to lock the connector 302 in the top portion 304 (and hence in the receptacle 200). For example, the user may give a quarter turn to the connector 302 to lock the connector 302 to the receptacle 200. Specifically, when the user rotates the connector 302, the locking pins 314 may be inserted into respective notches (such as a notch 316) located in the top portion 304. A notch shape and size may be complimentary to a locking pin shape and size, thus enabling the user to conveniently rotate the connector 302. In this manner, the connector 302 may be securely connected to the receptacle 200 via the locking pins 314.

When the connector 302 may be connected to the receptacle 200, the user may conveniently pick the receptacle 200 via the connector tubular body or the connector proximal portion 312. In some aspects, when the connector 302 may be connected to the receptacle 200, the connector distal portion 310 may be fully inserted in the top portion 304, and remaining connector portions may remain out of the top portion 304 (i.e., remain above the top surface 202). The connector portions that may remain above the top surface 202 may be used by the user to pick the receptacle 200 via the connector 302.

In some aspects, the middle portion 306, which acts as a positive stop as described above, limits the connector movement inside the stepped hole 208 when the user inserts the connector 302 into the stepped hole 208 via the top portion 304. Stated another way, the middle portion 306 prevents the connector 302 from sliding out of the stepped hole 208 (from stepped hole bottom end) when the user inserts the connector 302 into the stepped hole 208. In this manner, the user can conveniently insert and lock the connector 302 in the stepped hole 208 (and hence the receptacle 200).

In additional aspects, the connector proximal portion 312 may include a lead-in chamfer that may be configured to be inserted into another receptacle 400 (shown in FIG. 4, same as the top receptacle 102*a*). Specifically, the connector proximal portion 312 may be inserted into a bottom portion (e.g., the bottom portion 308) of a stepped hole (e.g., the stepped hole 208) of the receptacle 400, which may enable the receptacle 400 to be stacked over the receptacle 200 (thus enabling interlocking of the receptacles 200 and 400), as shown in FIG. 4.

In some aspects, a connector proximal portion length that gets inserted into stepped hole bottom portion of the receptacle 400 may be equivalent to a connector distal portion length that gets inserted into the top portion 304. Further, respective connector proximal portion length and connector distal portion length may be less than half of connector 302 length, thereby ensuring that when the receptacles 200 and 400 are stacked over each other, a predetermined distance may remaining between the opposing surfaces of the receptacles 200 and 400. Stated another way, when the receptacle 400 may be stacked over the receptacle 200, a predetermined distance may remain between the top surface 202 and a receptacle 400 bottom surface. A person ordinarily skilled in the art may appreciate that the predetermined distance may be equivalent to a sum of the connector proximal portion length and the connector distal portion length, subtracted from a total connector 302 length. The predetermined distance may assist the user in conveniently disassembling or removing the receptacle 400 from the stack of receptacles 200, 400, when the user desires to pick the receptacle 400. The predetermined distance may further prevent ammunition damage (e.g., the ammunition that may be stored in the receptacles 200, 400) as opposing surfaces of the receptacles 200, 400 may not contact. In some aspects, the predetermined distance may be based on ammunition dimensions.

Figure 5:
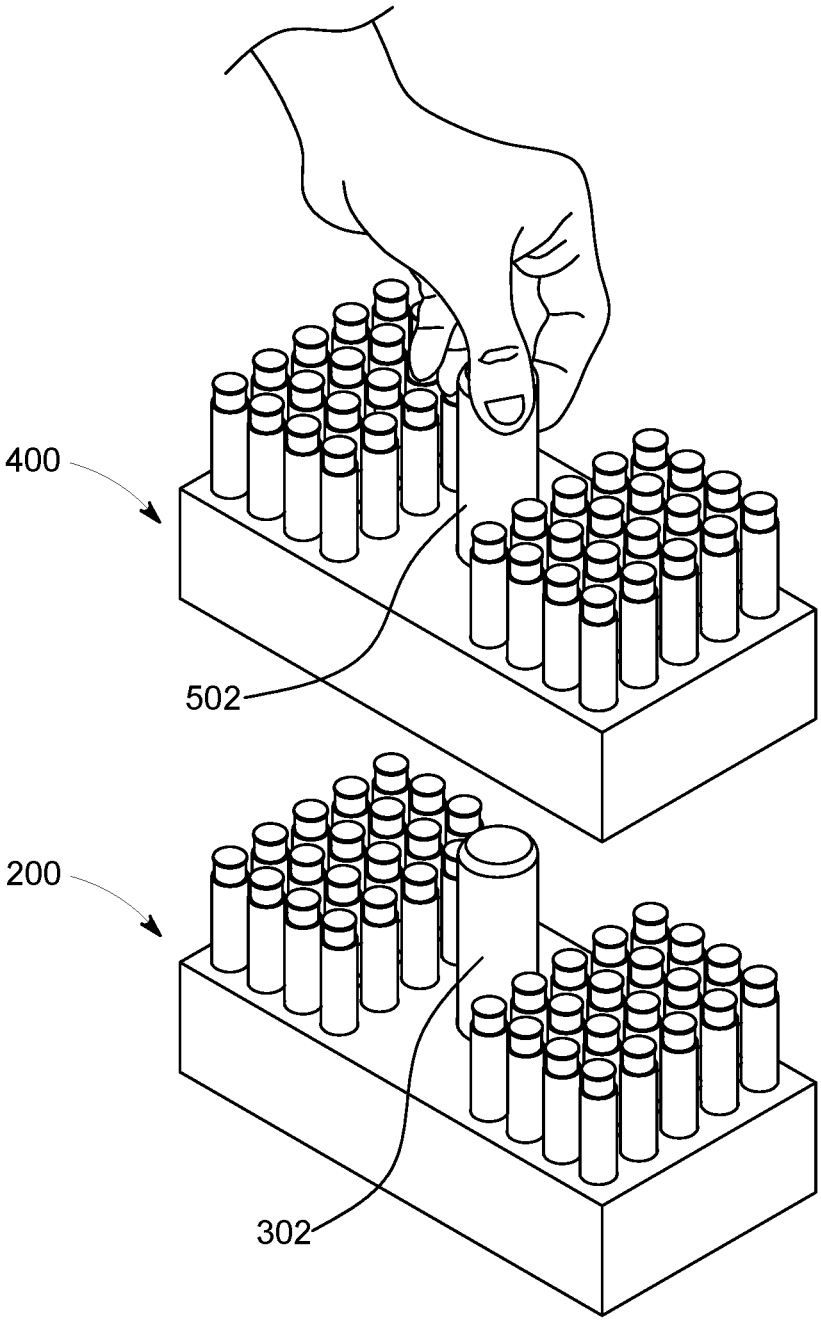
FIG. 5 depicts a snapshot of disengagement of a receptacle from a stacked arrangement of receptacles in accordance with the present disclosure.

FIG. 5 depicts a snapshot of disengagement of a receptacle (e.g., the receptacle 400) from a stacked arrangement of receptacles 200, 400 in accordance with the present disclosure. The receptacle 200 (e.g., first receptacle 200) may be attached to the connector 302 (e.g., first connector 302), and the receptacle 400 (e.g., second receptacle 400) may be attached to the connector 502 (e.g., second connector 502).

The second connector 502 may be attached to the receptacle 400 (e.g., receptacle 400 top portion) in the same manner as the connector 302 may be attached to the receptacle 200. Stated another way, the second connector 502 may include a locking mechanism that may be same as the locking mechanism associated with the first connector 302.

The receptacle 400 may be attached to the first connector 302 and the second connector 502. The first connector 302 may be attached to a receptacle 400 bottom portion (e.g., a bottom portion of a stepped hole associated with the second receptacle 400) and the second connector 502 may be attached to a receptacle 400 top portion (e.g., a stepped hole top portion associated with the second receptacle 400). The first connector 302 and the second connector 502 may be attached to the second receptacle 400 such that the first connector 302 and the second connector 502 may not be in contact each other (due to presence of a stepped hole middle portion or the "positive stop" of the stepped hole).

The second connector 502 may assist the user in picking the second receptacle 400 from "stacked" first and second receptacle arrangement, when the user desires to pick the second receptacle 400 off the stacked arrangement, as depicted in FIG. 5. In some aspects, when the user picks the second receptacle 400 (using the second connector 502), the first connector 302 may be detached from the receptacle 400 (e.g., receptacle bottom portion).

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a feature, structure, or characteristic is described in connection with an embodiment, one skilled in the art will recognize such feature, structure, or characteristic in connection with other embodiments whether or not explicitly described.

It should also be understood that the word "example" as used herein is intended to be non-exclusionary and non-limiting in nature. More particularly, the word "example" as used herein indicates one among several examples, and it should be understood that no undue emphasis or preference is being directed to the particular example being described.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating various embodiments and should in no way be construed so as to limit the claims.

Accordingly, it is to be understood that the above description is intended to be illustrative and not restrictive. Many embodiments and applications other than the examples provided would be apparent upon reading the above description. The scope should be determined, not with reference to the above description, but should instead be determined with reference to the appended claims, along with the full scope of equivalents to which such claims are entitled. It is anticipated and intended that future developments will occur in the technologies discussed herein, and that the disclosed systems and methods will be incorporated into such future embodiments. In sum, it should be understood that the application is capable of modification and variation.

All terms used in the claims are intended to be given their ordinary meanings as understood by those knowledgeable in the technologies described herein unless an explicit indication to the contrary is made herein. In particular, use of the singular articles such as "a," "the," "said," etc., should be read to recite one or more of the indicated elements unless a claim recites an explicit limitation to the contrary. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. A system comprising:

a bottom receptacle configured to hold a first set of items, wherein the bottom receptacle comprises a first stepped hole at a bottom receptacle center portion, wherein the first stepped hole comprises a first top portion, a first middle portion, and a first bottom portion, and wherein a first middle portion diameter is less than a first top portion diameter and a first bottom portion diameter;

a top receptacle configured to hold a second set of items, wherein the top receptacle is configured to be stacked over the bottom receptacle, wherein the top receptacle comprises a second stepped hole at a top receptacle center portion, wherein the second stepped hole comprises a second top portion, a second middle portion, and a second bottom portion, and wherein a second middle portion diameter is less than a second top portion diameter and a second bottom portion diameter; and a first connector comprising:

a first tubular body having a first connector distal portion and a first connector proximal portion; and a first locking mechanism disposed at the first connector distal portion, wherein the first locking mechanism is configured to lock the first connector distal portion to a bottom receptacle proximal portion, and wherein the first connector proximal portion is configured to removably attach to a top receptacle distal portion, wherein the first connector distal portion is configured to be inserted in the first top portion of the first stepped hole, and wherein the first connector proximal portion is configured to be inserted in the second bottom portion of the second stepped hole.

2. The system of claim 1, wherein the top receptacle and the bottom receptacle have equivalent dimensions and shape.

3. The system of claim 1, wherein the bottom receptacle comprises a first set of slots to receive the first set of items and the top receptacle comprises a second set of slots to receive the second set of items.

4. The system of claim 3, wherein each slot of the first set of slots and each slot of the second set of slots have equivalent size.

5. The system of claim 1, wherein the first locking mechanism comprises one or more locking pins disposed on an exterior surface of the first connector distal portion.

6. The system of claim 5, wherein the one or more locking pins and the first tubular body form a unified structure of the first connector.

7. The system of claim 5, wherein the one or more locking pins are configured to be locked in the first stepped hole.

8. The system of claim 1, wherein the bottom receptacle and the top receptacle are stacked at a predefined distance from each other via the first connector, wherein the predefined distance is a distance between a top surface of the bottom receptacle and a bottom surface of the top receptacle, and wherein the predefined distance is greater than zero.

9. The system of claim 8, wherein the predefined distance is based on dimensions of the first set of items.

10. The system of claim 1 further comprising a second connector having a second locking mechanism, wherein the second locking mechanism is configured to lock a second connector distal portion to a top receptacle proximal portion.

11. The system of claim 1, wherein the first set of items and the second set of items comprises ammunition.

12. The system of claim 1, wherein the bottom receptacle and the top receptacle are stacked in a container.

13. A system comprising:

a bottom receptacle configured to hold a first set of items, wherein the bottom receptacle comprises a first stepped hole at a bottom receptacle center portion, wherein the first stepped hole comprises a first top portion, a first middle portion, and a first bottom portion, and wherein a first middle portion diameter is less than a first top portion diameter and a first bottom portion diameter;

a top receptacle configured to hold a second set of items, wherein the top receptacle is configured to be stacked over the bottom receptacle, wherein the top receptacle comprises a second stepped hole at a top receptacle center portion, wherein the second stepped hole comprises a second top portion, a second middle portion, and a second bottom portion, and wherein a second middle portion diameter is less than a second top portion diameter and a second bottom portion diameter; and a first connector comprising:

a first tubular body having a first connector distal portion and a first connector proximal portion; and a first locking mechanism disposed at the first connector distal portion, wherein the first locking mechanism is configured to lock the first connector distal portion to a bottom receptacle proximal portion, and wherein the first connector proximal portion is configured to removably attach to a top receptacle distal portion, wherein the first locking mechanism comprises one or more locking pins disposed on an exterior surface of the first connector distal portion, and wherein the one or more locking pins are configured to be locked in the first stepped hole, wherein the first connector distal portion is configured to be inserted in the first top portion of the first stepped hole, and wherein the first connector proximal portion is configured to be inserted in the second bottom portion of the second stepped hole.

14. The system of claim 13, wherein the bottom receptacle comprises a first set of slots to receive the first set of items and the top receptacle comprises a second set of slots to receive the second set of items.

15. The system of claim 14, wherein each slot of the first set of slots and each slot of the second set of slots have equivalent size.

16. The system of claim 13 further comprising a second connector having a second locking mechanism, wherein the second locking mechanism is configured to lock a second connector distal portion to a top receptacle proximal portion.

17. A system comprising:

a bottom receptacle configured to hold a first set of items, wherein the bottom receptacle comprises a first set of slots to receive the first set of items, wherein the bottom receptacle comprises a first stepped hole at a bottom receptacle center portion, wherein the first stepped hole comprises a first top portion, a first middle portion, and a first bottom portion, and wherein a first middle portion diameter is less than a first top portion diameter and a first bottom portion diameter;

a top receptacle configured to hold a second set of items, wherein the top receptacle comprises a second set of slots to receive the second set of items, wherein the top receptacle is configured to be stacked over the bottom receptacle, wherein the top receptacle comprises a second stepped hole at a top receptacle center portion, wherein the second stepped hole comprises a second top portion, a second middle portion, and a second bottom portion, and wherein a second middle portion diameter is less than a second top portion diameter and a second bottom portion diameter; and a first connector comprising:

a first tubular body having a first connector distal portion and a first connector proximal portion; and a first locking mechanism disposed at the first connector distal portion, wherein the first locking mechanism is configured to lock the first connector distal portion to a bottom receptacle proximal portion, and wherein the first connector proximal portion is configured to removably attach to a top receptacle distal portion, wherein the first locking mechanism comprises one or more locking pins disposed on an exterior surface of the first connector distal portion, and wherein the one or more locking pins configured to be locked in the first stepped hole, wherein the first connector distal portion is configured to be inserted in the first top portion of the first stepped hole, and wherein the first connector proximal portion is configured to be inserted in the second bottom portion of the second stepped hole.

18. The system of claim 1, wherein the first connector is located between the bottom receptacle and the top receptacle.

19. The system of claim 1, wherein the first connector proximal portion comprises a lead-in chamfer configured to be inserted in the second bottom portion of the second stepped hole.

20. The system of claim 1, wherein the first middle portion prevents movement of the first connector distal portion in the first bottom portion of the first stepped hole, and wherein the second middle portion prevents movement of the first connector proximal portion in the second top portion of the second stepped hole.

* * * * *